United States Patent [19]

Randone

[11] Patent Number: 5,040,385

[45] Date of Patent: Aug. 20, 1991

[54] UNIVERSAL PERSONAL PROPERTY LOCKING DEVICE

[75] Inventor: Charles J. Randone, Omaha, Nebr.

[73] Assignee: ARC Enterprises, Omaha, Nebr.

[21] Appl. No.: 425,689

[22] Filed: Oct. 23, 1989

[51] Int. Cl.[5] ..... E05B 73/00

[52] U.S. Cl. ..... 70/62; 70/234; 70/235; 70/DIG. 41; 211/4; 211/70.5

[58] Field of Search ..... 70/DIG. 41, 58, 59, 70/62, 234, 235; 211/4, 5, 9, 70.5; 194/259, 285, 286

[56] References Cited

U.S. PATENT DOCUMENTS

| | | | |
|---|---|---|---|
| 428,814 | 5/1890 | Morse | 211/9 |
| 438,526 | 10/1890 | Butler | 70/40 |
| 614,826 | 11/1898 | Beardsley et al. . | |
| 639,517 | 12/1899 | Butcher | 211/5 |
| 1,308,333 | 7/1919 | Choma | 194/285 |
| 3,518,852 | 7/1970 | Orr | 70/25 |
| 3,739,609 | 6/1973 | Kaufmann | 70/234 |
| 3,749,295 | 7/1973 | Palmer | 70/54 X |
| 3,762,569 | 10/1973 | Spring | 70/235 X |
| 3,783,659 | 1/1974 | Rossi | 70/234 |
| 3,785,500 | 1/1974 | Kennelly | 211/5 |
| 3,786,928 | 1/1974 | Johnson | 211/5 |
| 3,815,721 | 6/1974 | Montoya et al. | 70/18 X |
| 3,820,662 | 6/1974 | Steers | 70/128 X |
| 3,827,773 | 8/1974 | Aiello | 70/234 X |
| 3,865,244 | 2/1975 | Galen et al. | 211/5 |
| 3,865,245 | 2/1975 | Lieb et al. | 70/234 X |
| 3,865,246 | 2/1975 | Lieb et al. | 211/5 |
| 3,874,202 | 4/1975 | Effenheim | 211/70.5 X |
| 3,887,075 | 6/1975 | Harvey | 211/5 |
| 3,920,126 | 11/1975 | Candlin | 211/5 |
| 3,942,646 | 3/1976 | Nelson et al. | 211/5 |
| 3,944,079 | 3/1976 | Boslough | 70/234 X |
| 3,964,610 | 6/1976 | Deiner | 70/62 X |
| 3,964,611 | 6/1976 | Galen et al. | 211/5 |
| 3,970,196 | 7/1976 | Legge | 211/5 |
| 3,970,197 | 7/1976 | Bale, Jr. | 211/5 |
| 4,245,745 | 1/1981 | Verelle et al. | 211/70.5 X |
| 4,316,544 | 2/1982 | Goldstein | 70/234 X |
| 4,669,769 | 6/1987 | Leto | 70/DIG. 64 X |
| 4,763,499 | 8/1988 | Boyle | 70/452 X |

FOREIGN PATENT DOCUMENTS

| | | | |
|---|---|---|---|
| 123116 | 7/1900 | Fed. Rep. of Germany | 70/237 |
| 2430501 | 3/1980 | France | 70/59 |
| 8204046 | 5/1984 | Netherlands | 211/5 |
| 8204137 | 5/1984 | Netherlands | 211/5 |
| WO 83/01646 | 5/1983 | PCT Int'l Appl. | 70/233 |
| 41970 | 9/1907 | Switzerland | 194/286 |

*Primary Examiner*—Lloyd A. Gall

*Attorney, Agent, or Firm*—John A. Beehner

[57] ABSTRACT

A universal personal property locking device for releasably securing articles of personal property against unauthorized removal. The locking device includes a housing adapted to be mounted on a support surface and a generally U-shaped receptacle secured to the housing. In a preferred embodiment the receptacle has opposite closed ends and open ends so that an article inserted into the receptacle through the open end can only be removed from the open end. A lock bar is movably supported in the housing for back and forth movement between locked and unlocked positions. The lock bar extends out of the housing across the open end of the receptacle in its locked position and is moved away from the open end of the receptacle in its unlocked position, thereby to enable the insertion and removal of articles of personal property into and from the receptacle. A releasable lock mechanism in the housing is operative to releasably secure the lock bar in the locked position thereof.

13 Claims, 7 Drawing Sheets

UNIVERSAL PERSONAL PROPERTY LOCKING DEVICE

BACKGROUND OF THE INVENTION

The universal personal property locking device of the present invention is directed generally to a device for securing valuable personal property against unauthorized taking and more particularly to a rugged compact locking device which readily accommodates the securement of personal property of various sizes and shapes.

It is often necessary for one to leave personal property in public for at least short times. Skiers often leave their skis in racks at the base of the slopes and outside of restaurants on the slopes. Baby buggies and strollers often have to be left outdoors when entering certain buildings or outside the confines of amusements and the like. Skateboards, bicycles and surfboards likewise often need to be left unattended in public for short periods of time for all sorts of reasons. Bicycles and moped motor bikes, which are easily carried off by a thief, generally need to be left unattended at ones destination.

Since the theft of such personal property items may cause great hardship for the owner both by immediate inconvenience and economic loss thereafter, there is a need for preventing the unauthorized taking of such personal property at public places where it must be left unattended The public generally bears the cost of such thefts in terms of personal reimbursement and increased personal property insurance rates.

Coin operated lockers are often provided for patrons at airports, skating rinks, health clubs and the like, but most of the above mentioned articles of personal property are not suited for placement into available lockers. Whereas an individual can carry a heavy padlock, chain or steel locking device, with them for securing personal property to sign posts, light posts and the like, that is inconvenient and could damage said personal property and results in the disorderly and perhaps unsightly placement of personal property and may be against the rules of the premises where the property is to be left.

A primary object of the invention therefore is to provide a universal locking device for releasably securing articles of personal property against unauthorized removal.

Another object is to provide such a locking device which accommodates the insertion and removal of various a-ticles of personal property which differ greatly in size and shape.

Another object is to provide such a locking device which is adapted for alternate mounting either to a wall or ground surface using one or multiple posts as mounting instruments.

Another object is to provide such a locking device which is rugged in construction to withstand both accidental impact and intentional vandalism.

Another object is to provide such a locking device which is simple in construction and easily operated by members of the public without undue difficulty or training.

Another object of the invention is to provide such a locking device wherein the actuating key or combination of numbers thereof is at least partially shielded from impact by accident or vandalism.

Another object of the invention is to allow for the regulation of chattel placement at places where people gather, and a means for exacting funds for the administration of such control.

Finally, it is an object to provide such a locking device which is rugged and durable in construction and efficient in operation.

SUMMARY OF THE INVENTION

The personal property locking device of the present invention includes a housing adapted to be mounted on a support surface and a generally U-shaped receptacle secured to the housing.

The receptacle preferably has opposite closed ends and open ends so that an article inserted into the receptacle through the open end can only be removed through the open end. A lock bar is movably supported in the housing for back and forth movement between locked and unlocked positions. The lock bar extends out of the housing across the open end of the receptacle and its locked position and is moved away from the open end of the receptacle in its unlocked position, thereby to enable the insertion and removal of articles of personal property into and from the receptacle. A releasable lock mechanism in the housing is operative to releasably secure the lock bar in the locked position thereof.

The lock mechanism may be a coin operated mechanism which provides the user with a removable key or it may be a self contained combination lock mechanism. In either case, the lock mechanism controls the movement of a lock finger which is moveable into and away from the path of movement of the lock bar to releasably secure the lock bar in the locked and unlocked positions respectively.

A removable U-shaped collar is provided so that the housing may alternately be mounted on either a wall surface or post ground surface using one or multiple posts as mounting instruments. The U-shaped receptacle is preferably pivotally adjustable about the axis of the lock bar to any and various selected positions to accommodate particular types of personal property articles.

Both the releasable lock mechanism and any axis openings to the housing are preferably arranged on housing walls which are recessed interiorly of the housing to at least partially shield such structures from impact caused either by accident or vandalism.

DESCRIPTION OF THE PREFERRED EMBODIMENTS

Figure 5:
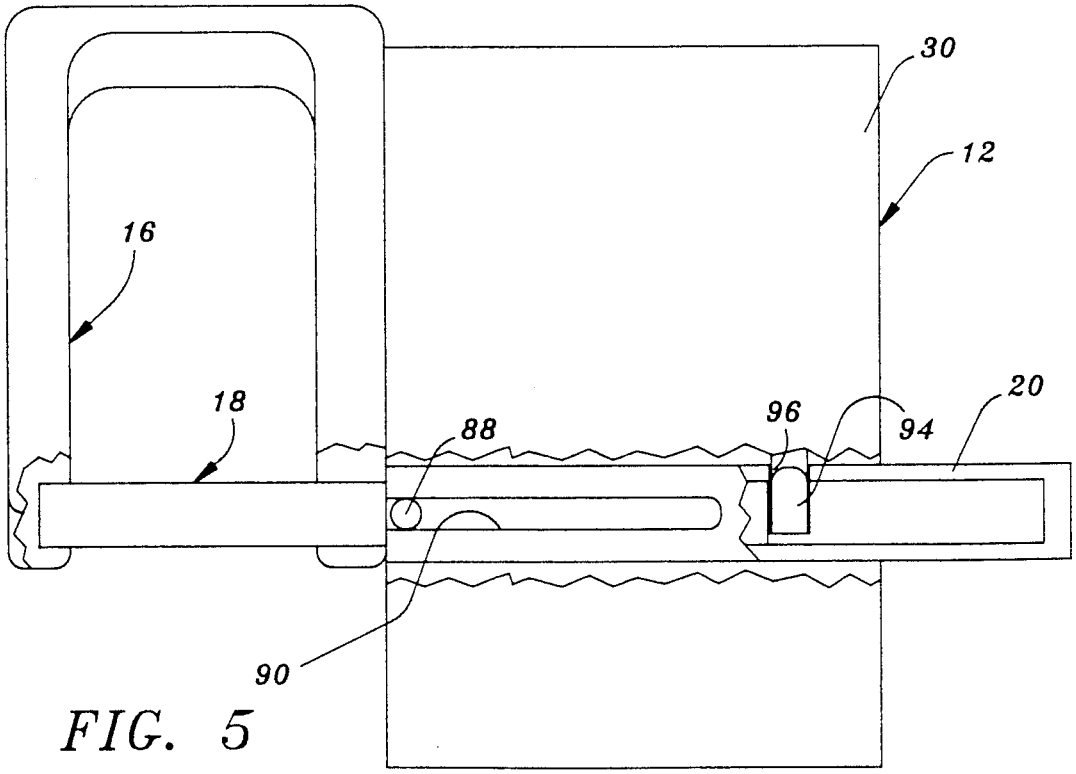
FIG. 5 is a partially sectional side elevational of the locking device with portions broken away to show the lock bar in the locked position thereof.
Figure 6:
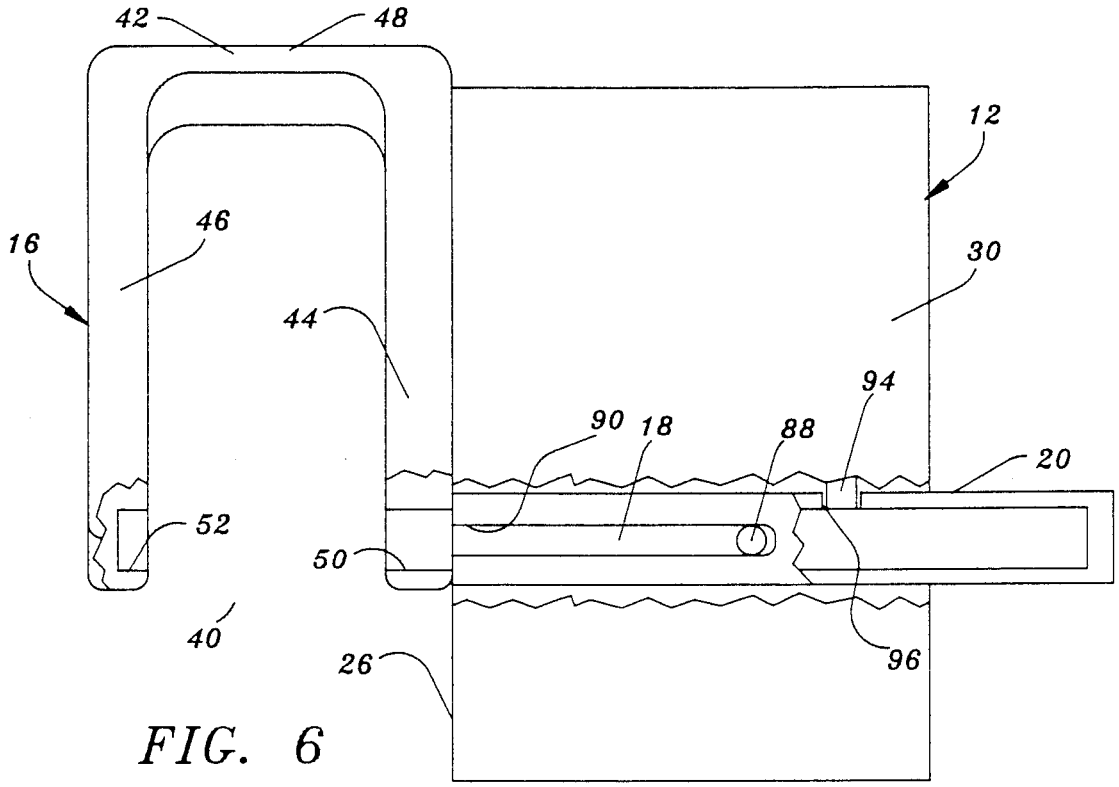
FIG. 6 is a partially sectional side elevational view of the locking device with portions broken away to show the locked bar in the unlocked, position thereof.
Figure 7:
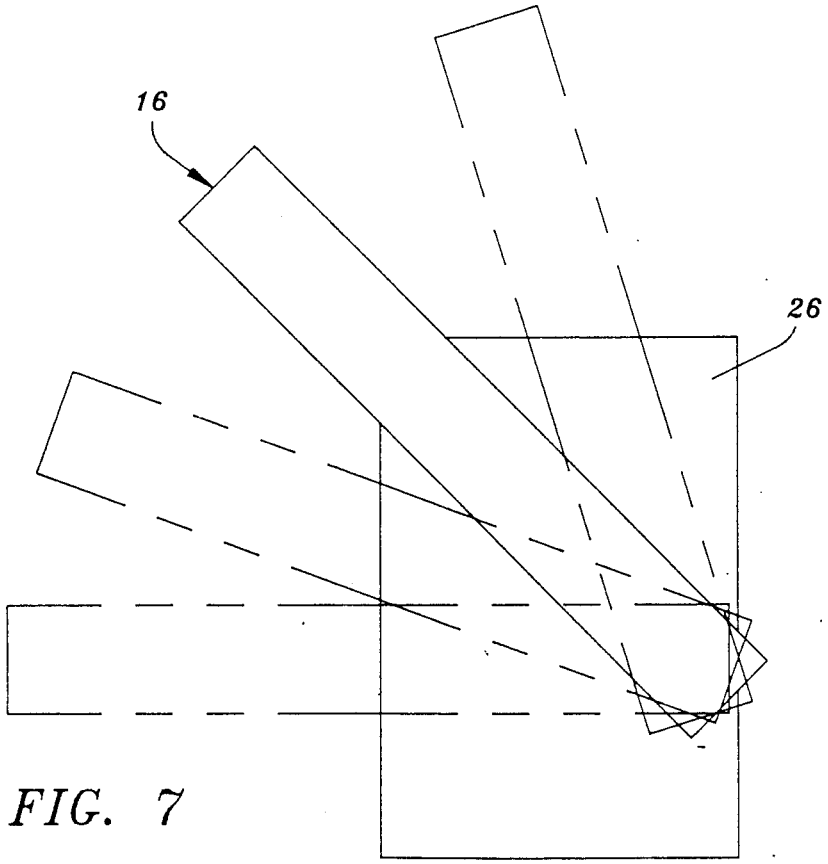
FIG. 7 is a rear elevational view indicating various adjusted positions for the U-shaped receptacle of the invention.
Figure 8:
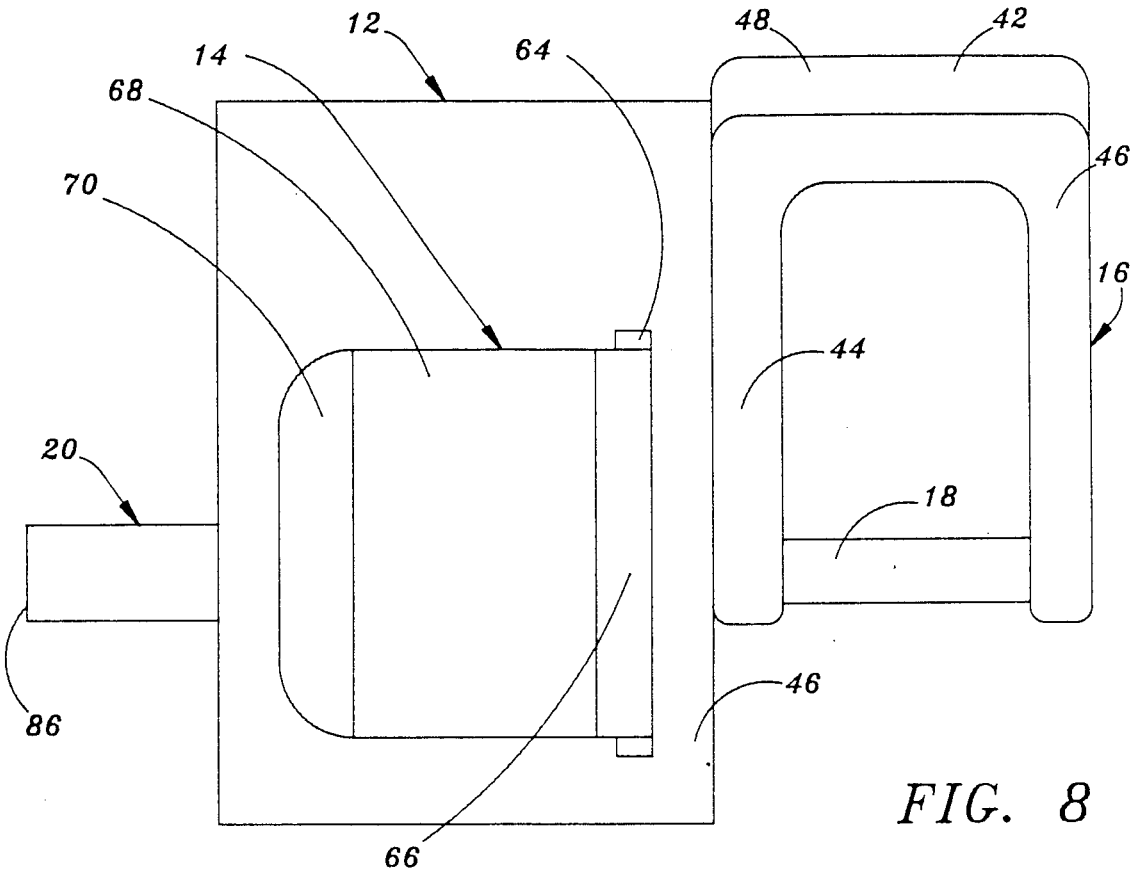
FIG. 8 is an opposite side elevational view of the invention.
Figure 9:
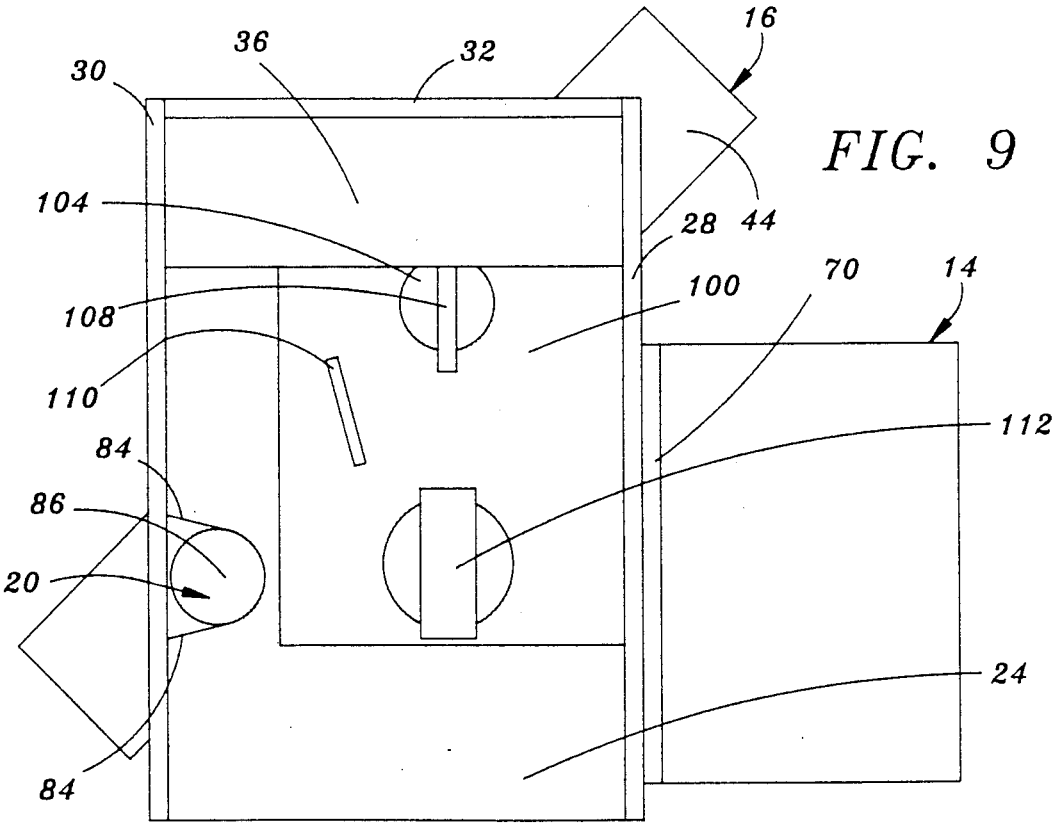
FIG. 9 is a front elevational view of the invention illustrating a releasable key locking mechanism.
Figure 10:
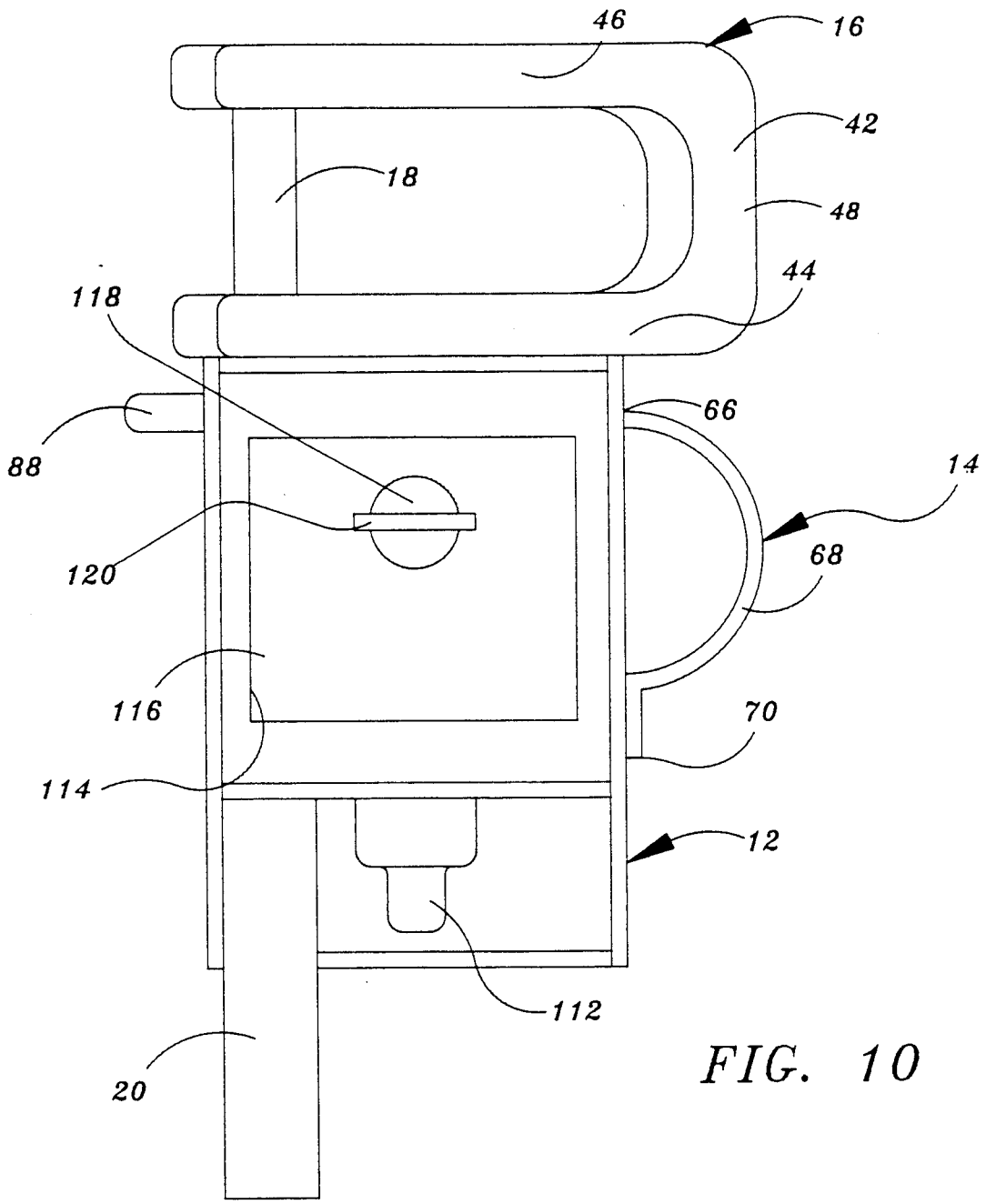
FIG. 10 is a bottom plan view of the invention.
Figure 11:
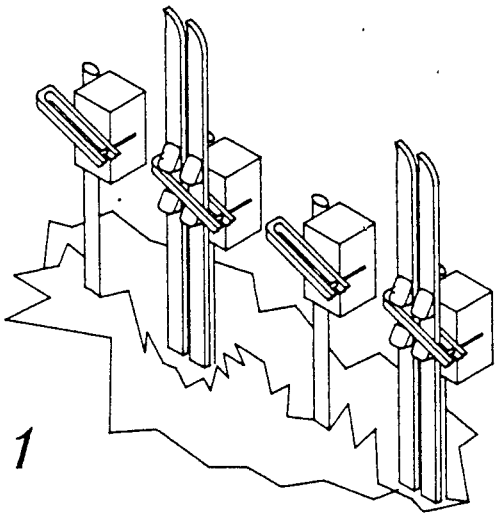
FIG. 11 is a perspective view of the invention in use.

The Universal Personal Property Locking Device 10 of the present invention is illustrated in the drawings as including a lock housing 12 having a mounting bracket 14 on one side thereof and a generally U-shaped receptacle 16 on the rear side. A lock bar 18 is reciprocally moveable within a support sleeve 20 in housing 12 for movement between locked and unlocked positions (FIG. 5).

Wherein the lock bar 18 extends across and closes the open end of the U-shaped receptacle 16 and the unlocked position of FIG. 6. In that position, the lock bar 18 is moved away from the open end of the receptacle 16 to enable the insertion and removal of personal property articles into and from the receptacle. Finally, a releasable lock mechanism 22 is actuatable by an operator to releasably secure the lock bar in the locked position for temporarily securing an article of personal property against unauthorized removal. The lock mechanism 22 may be a coin operated mechanism with a key removable by the user or a self-contained combination lock mechanism.

Figure 1:
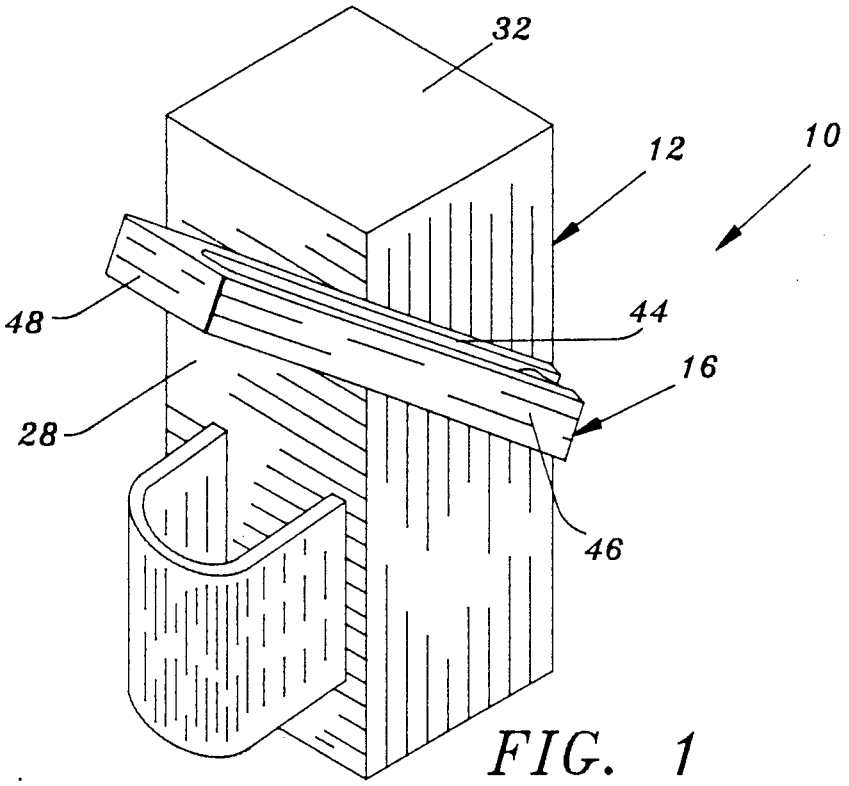
FIG. 1 is a perspective rear and side view of the Universal Personal Property Locking Device of the invention.
Figure 2:
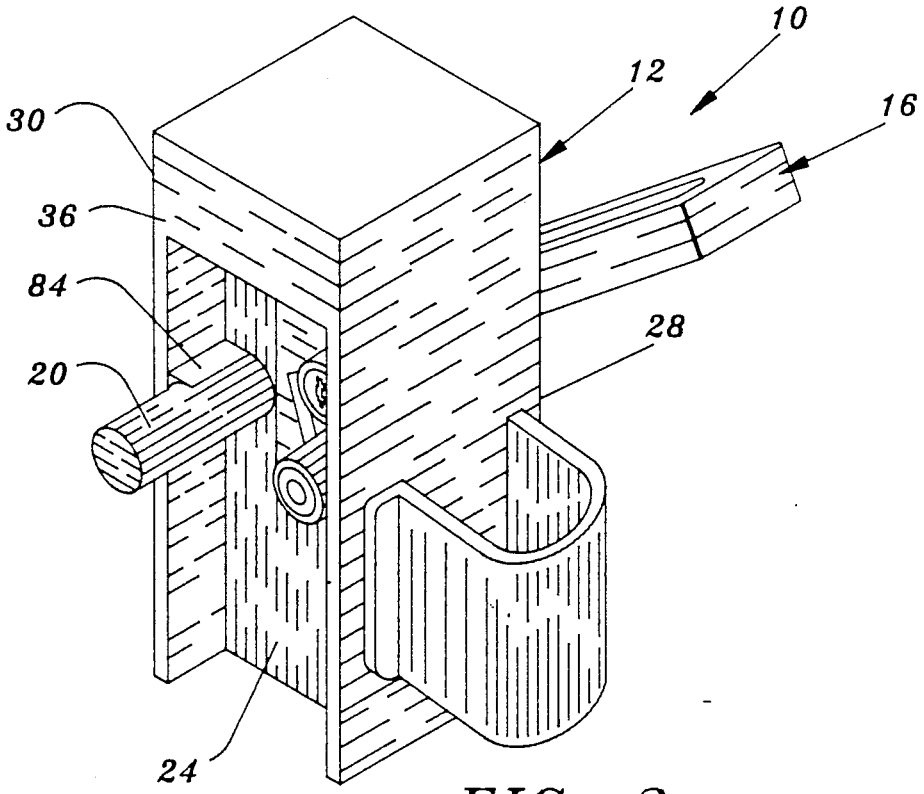
FIG. 2 is a perspective front and side view of the invention.
Figure 3:
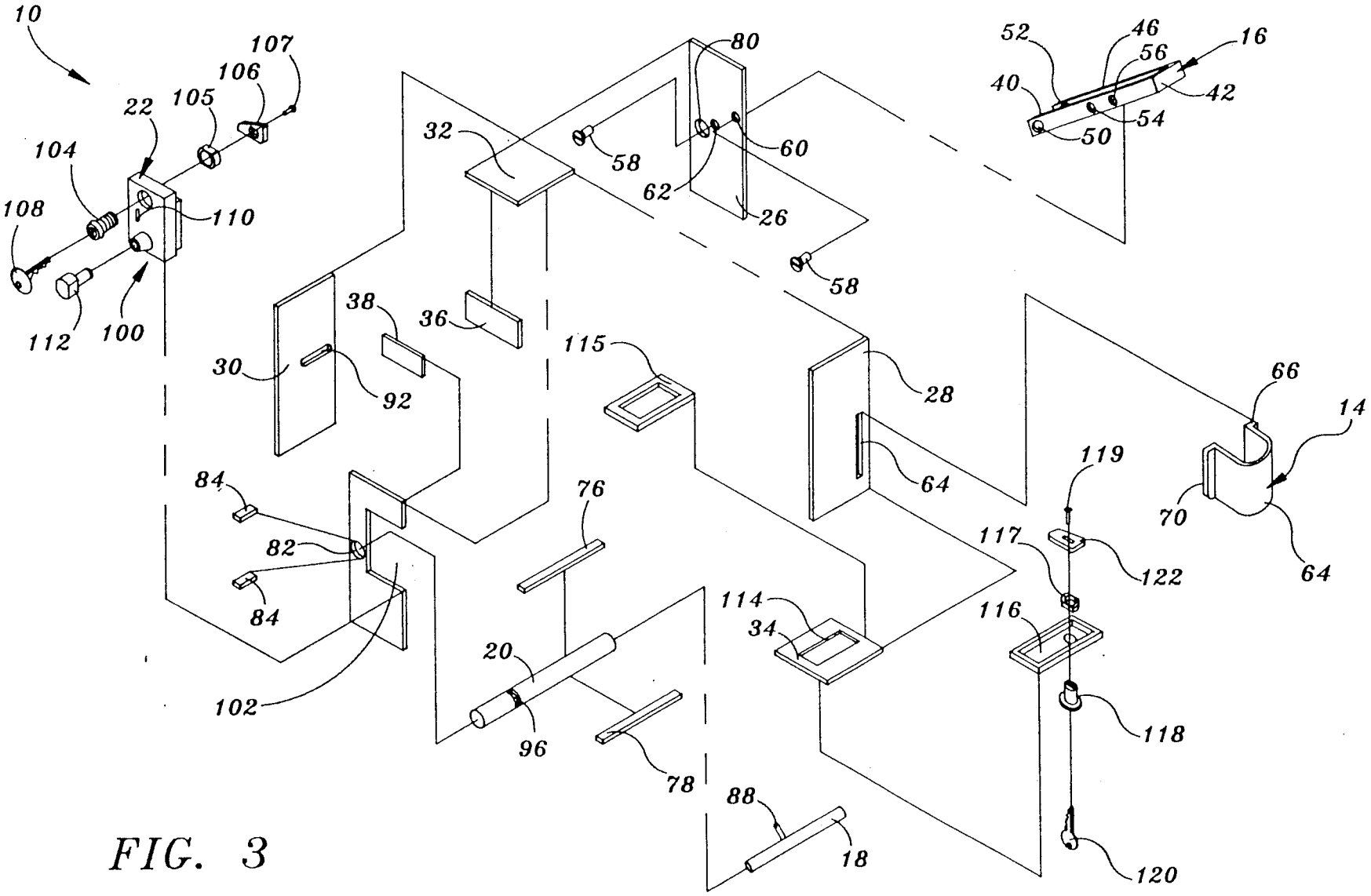
FIG. 3 is an exploded perspective view of the preferred embodiment of FIGS. 1 and 2.

Locking housing 12 includes a front wall 24, rear wall 26, opposite sidewalls 28 and 30, a top wall 32 and bottom wall 34. As shown in FIGS. 2 and 3, front wall 24 is recessed interiorly of the housing relative to the forward edges of sidewalls 28 and 30 to at least partially shield the lock mechanism 22 from impact. An upper front wall section 36 spans the front edges of the side walls at their upper ends to further shield the lock mechanism 22 from the top. A plate 38 (FIG. 3) closes the gap between the front wall 24 and front wall section 36. Similarly, bottom wall 34 is secured to sidewalls 28 and 30 and rear wall 26 at a position recessed above their lower edges to at least partially shield the bottom wall from unauthorized access.

The generally U-shaped receptacle 16 includes opposite open and closed ends 40 and 42 defined by a pair of sidewalls 44 and 46 and a rear cross member 48. Sidewall 44 has an opening 50 extended thereto adjacent the free end thereof to afford passage of lock bar 18 therethrough. Likewise, sidewall 46 has a socket 52 formed in the interior side thereof in alignment with opening 50 for receiving the free end of lock bar 18 in its locked position.

The position of receptacle 16 is not critical to the invention and it may be preferred to pivotally adjust the receptacle about the axis of the lock bar 18 to accommodate particular types of personal property articles. To secure the receptacle in a selected adjusted position, side wall 44 may be additionally provided with a pair of threaded sockets 54 and 56 for receiving bolts 58 extending through aligned openings 60 and 62 in housing rear wall 26. Accordingly, the securement bolts 58 are inaccessible exteriorly of the housing.

For mounting the housing on an upright post, sidewall 28 is provided with an upright slot 64 for releasably receiving a flanged end 66 of a generally U-shaped collar 68. Upon placement of the collar around a support post, free end 70 is engaged against the sidewall 28 and rigidly secured thereto by welding or any other suitable means. The housing could alternately be attached to a wall surface by screws or bolts inserted through appropriately placed holes in one or the other of the sidewalls. It may be necessary to secure the housing adjacent the edge of a wall surface so that the wall does not interfere with proper positioning of the receptacle 16.

The lock bar 18 is reciprocally axially movable within a lock bar support sleeve 20. Sleeve 20 is preferably welded or otherwise rigidly secured to housing sidewall 30 and may be reinforced with gussets 76 and 78. Sleeve 20 is axially positioned to terminate at rear wall 26 in alignment with a lock bar opening 80 which is positioned for registration with opening 50 through receptacle 16. The forward end of sleeve 20 protrudes exteriorly through an opening 82 in front wall 24 and is likewise exteriorly secured to the front edge of sidewall 30 with additional gussets places 84. The forward end 86 of sleeve 20 is closed to shield the lock bar 18 from exterior access.

Figure 4:
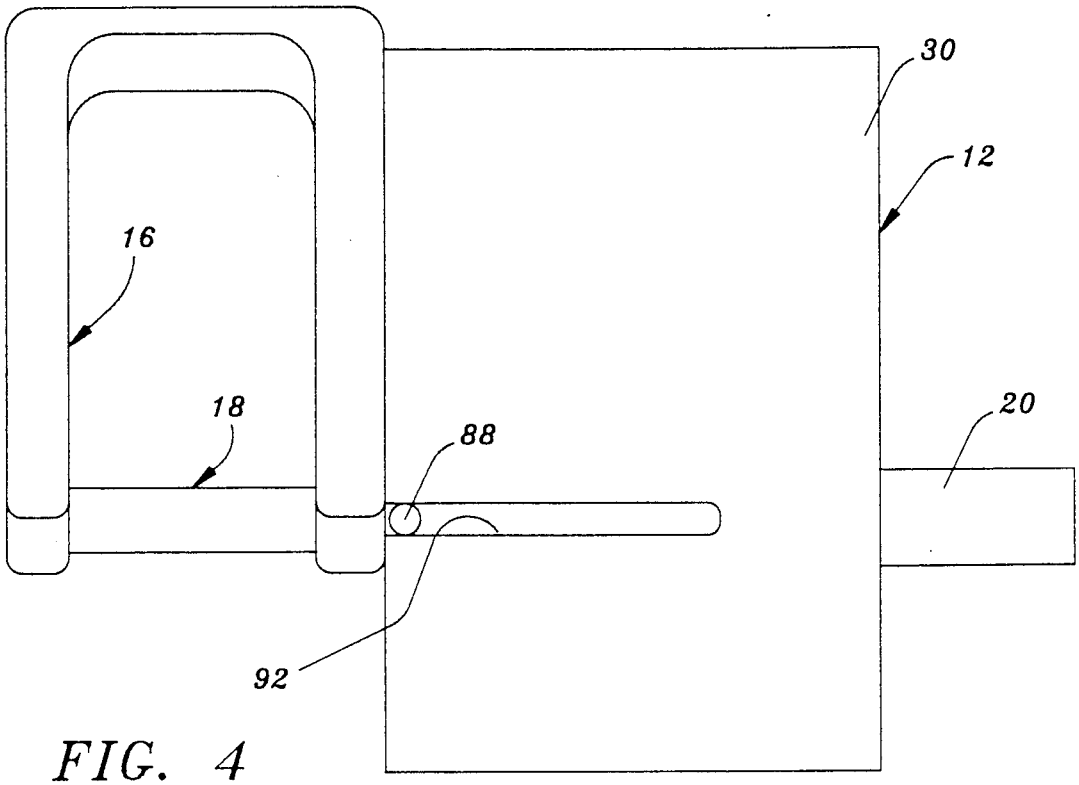
FIG. 4 is a side elevational view of the locking device.

To manually reciprocate lock bar 18 between its locked and unlocked positions, the lock bar is provided with a push-pull tab 88 which protrudes exteriorly through an elongated axial slot 90 in sleeve 20, as best shown in FIGS. 5 and 6 and through a registered slot 92 in sidewall 30 as shown in FIG. 4. On rearward movement of tab 88 to the locked position of the lock bar 18, as illustrated in FIG. 5, a lock finger 94 is insertable through a slot 96 in sleeve 20 into the slide path of lock bar 18 at a position to block withdrawal of the lock bar from its locked position. Upon withdrawal of the lock finger 94 from the slide path of the lock bar 18, as illustrated in FIG. 6, the lock bar may be pulled forward to its unlocked position for releasing whatever article may have been secured within receptacle 16.

Movement of lock finger 94 is controlled by a releasable lock mechanism 100. In the preferred embodiment illustrated, the lock mechanism 100 seats within an appropriate cutout 102 in front wall 24 and may be releasably locked in its seated position by a mechanism 104 having a toggle 106 pivotally moveable 90° by a removable key 108 for locking and unlocking mechanism 100 from its seated position within front wall 24. The exterior face of lock mechanism 100 presents a coin inset opening 110 which for receiving coins to enable rotation of removable key 112 to move the lock finger 94 between its locked and unlocked positions of FIGS. 5 and 6 respectively.

Figure 12:
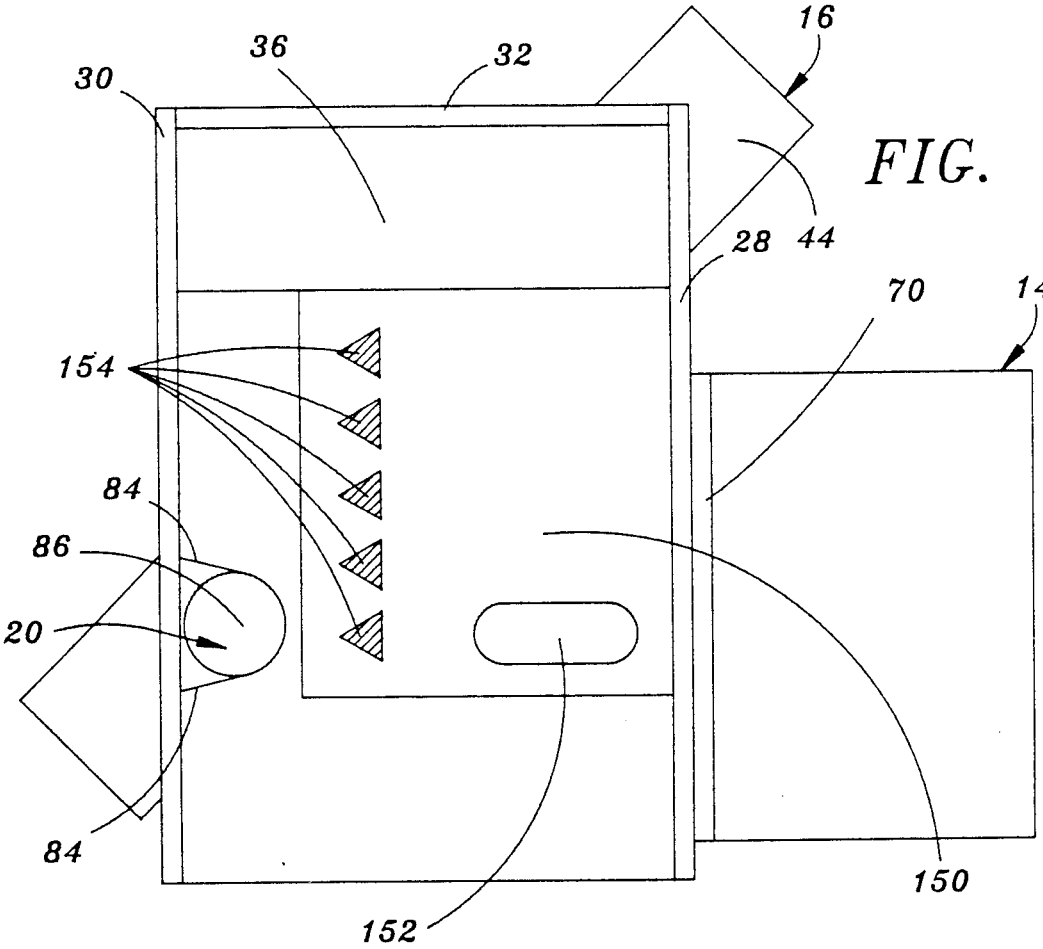
FIG. 12 is a front elevational view of the invention illustrating a releasable combination locking mechanism.

The particular type of lock mechanism 100 is not critical to the present invention. A preferred embodiment includes a coin operated lock mechanism manufactured by Secura Coin Lockers of 21003 Superior, Chatsworth Lake, Calif. 91311, which lock mechanisms are in commercial use on coin operated lockers. In the present invention, that lock mechanism is so positioned that the lock finger thereof is moveable into and from slot 96 in sleeve 20. Other key operated or combination lock mechanisms well known to those skilled in the art of locking mechanisms, may be substituted for the illustrated lock mechanism 100 such as a combination lock 150 having an engagement disengagement knob 152 and a plurality of combination buttons 154 (FIG. 12).

Coins received by lock mechanism 100 fall onto housing bottom wall 34 which is provided with an access opening 114 door 116 seats within access opening 114 and is releasably locked in its seated position by key operated toggle mechanism 118 similar to mechanism 104. A key 120 is operable for pivoting toggle 122 to engage bottom wall 34 and releasably retain door 116 in its closed and locked position.

Whereas the locking device 10 may be made of any rigid generally tamper proof material, a rust protected steel or stainless steel is preferred.

In operation, one can readily place a pair of skis into the open end of receptacle 16 with the binding situated above and below the receptacle so that the skis cannot be removed once the lock bar 18 is moved to its locked position. Likewise, a skateboard may be inserted therein with the front and rear wheels situated above and below the receptacle to secure therein. In the illustrated embodiment, an operator need only insert his article into receptacle 16, push tab 88 rearwardly to move the lock bar 18 to its locked position and then insert a coin into slot 110 of lock mechanism 100 to enable rotation of key 112 to move lock finger 94 into sleeve 20 behind lock bar 18. This also enables removal of key 112. When the user returns, the key 112 is simply reinserted into the lock ,mechanism, rotated 90° to withdraw lock finger 94 from sleeve 20, whereupon tab 88 is pulled forwardly to move lock bar 18 to its unlocked position and the article is readily removed from the open end of receptacle 16.

Whereas the invention has been disclosed in connection with a preferred embodiment thereof, it is apparent that many modifications, substitutions and additions may be made thereto which are within the intended broad scope of the appended claims.

Thus there has been shown and described a universal personal property locking device which accomplishes at least all of the stated objects.

I claim:

1. A universal personal property locking device for releasably securing articles of personal property against unauthorized removal, comprising:

a generally U-shaped receptacle having opposite side walls and opposite closed and open ends whereby goods insertable into said receptacle through the open end thereof can only be removed through said open end;

a housing;

means for securing said housing to said receptacle adjacent the open end thereof;

a lock bar having a longitudinal center line;

means for movably supporting said lock bar in said housing for back and forth movement between locked an unlocked positions, said lock bar extending out of said housing across the open end of said receptacle in the locked position thereof and being moved away from the open end of said receptacle in the unlocked position thereof to enable the insertion and removal of valuable goods into and from said receptacle;

a releasable lock mechanism in said housing and operative to releasably secure said lock bar in the locked position thereof; and wherein said U-shaped receptacle is pivotally adjustable about the longitudinal center line of said lock bar to selected positions relative to said housing.

2. The locking device of claim 1 wherein said releasable lock mechanism comprises a coin operated mechanism actuated by a removable key.

3. The locking device of claim 1 wherein said releasable lock mechanism comprises a combination lock.

4. The locking device of claim 1 wherein said lock bar is axially slidably moveable between the locked and unlocked positions thereof.

5. The locking device of claim 4 wherein said means for movably supporting said lock bar comprises a generally tubular lock bar support sleeve.

6. The locking device of claim 5 wherein said support sleeve is secured within said housing adjacent one sidewall of said housing, said sleeve and sidewall having registered elongated slots extended axially of said lock bar and said lock bar including a push-pull tab on said lock bar and extended outwardly through said registered slots for manually advancing and retracting said lock bar within said sleeve between the locked and unlocked positions thereof.

7. The locking device of claim 6 wherein said lock bar support sleeve includes a second slot and said releasable lock mechanism includes a lock finger registered with said second slot and moveable between a locked position within said sleeve to block axial withdrawal of said lock bar from the locked position thereof and an unlocked position wherein said lock finger is withdrawn from the slide path of the lock bar within the support sleeve to enable sliding movement of the lock bar to the unlocked position thereof.

8. The locking device of claim 7 wherein said lock mechanism further comprises a key operated means for moving said lock finger between the locked and unlocked positions thereof.

9. The locking device of claim 1 furthermore comprising means for mounting said housing on a support surface.

10. The locking device of claim 9 wherein said mounting means comprises a generally U-shaped collar operative to secure said housing to a post.

11. The locking device of claim 1 wherein said lock mechanism is supported on a wall of said housing which is recessed into the housing whereby said lock mechanism is partially shielded from accidental impact and vandalism.

12. The locking device of claim 2 further comprising coin collection means within said housing, and a housing bottom wall, said coin collection means being accessible through said bottom wall of said housing and said bottom wall being recessed into said housing to partially shield said coin collection means from unauthorized access.

13. The locking device of claim 1 wherein said means for securing said housing to said receptacle comprises at least one opening said housing, a closed ended threaded hole in a surface of said receptacle facing said housing at a position for registration with said opening through the housing and bolt means insertable through said opening and into said threaded hole in the receptacle whereby said bolt means is inaccessible externally of said housing.

* * * * *

UNITED STATES PATENT AND TRADEMARK OFFICE

CERTIFICATE OF CORRECTION

PATENT NO. : 5,040,385

DATED : August 20, 1991

INVENTOR(S) : Charles J. Randone

It is certified that error appears in the above—identified patent and that said Letters Patent is hereby corrected as shown below:

On the title page, item (73) Assignee:, change "ARC Enterprises" to -- ARC Products, Inc. --.

Signed and Sealed this

Twenty-fourth Day of November, 1992

*Attest:*

DOUGLAS B. COMER

*Attesting Officer*

*Acting Commissioner of Patents and Trademarks*